US011661953B2

(12) United States Patent
Song et al.

(10) Patent No.: US 11,661,953 B2
(45) Date of Patent: May 30, 2023

(54) PUMP

(71) Applicant: LG ELECTRONICS INC., Seoul (KR)

(72) Inventors: Youjoon Song, Seoul (KR); Minsu Son, Seoul (KR); Seungjo Baek, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 166 days.

(21) Appl. No.: 17/176,287

(22) Filed: Feb. 16, 2021

(65) Prior Publication Data

US 2021/0254631 A1 Aug. 19, 2021

(30) Foreign Application Priority Data

Feb. 17, 2020 (KR) ..... 10-2020-0019276

(51) Int. Cl.
*F04D 29/44* (2006.01)
*F04D 29/42* (2006.01)

(52) U.S. Cl.
CPC ..... *F04D 29/445* (2013.01); *F04D 29/4293* (2013.01)

(58) Field of Classification Search
CPC ..... F04D 29/426; F04D 29/4273; F04D 29/4293; F04D 29/444; F04D 29/445; F04D 29/448; F04D 29/666; F04D 29/667; F04D 29/669
See application file for complete search history.

(56) References Cited

U.S. PATENT DOCUMENTS

2006/0130661 A1* 6/2006 Dean ..... F04D 9/003 96/208

FOREIGN PATENT DOCUMENTS

EP 1024292 8/2000
EP 1249615 A2 * 10/2002 ..... F04D 17/164

OTHER PUBLICATIONS

Translation of Bosch EP 1249615 (Year: 2001).*

* cited by examiner

*Primary Examiner* — Woody A Lee, Jr.
*Assistant Examiner* — Brian O Peters
(74) *Attorney, Agent, or Firm* — Ked & Associates LLP

(57) ABSTRACT

A pump includes a housing which forms a suction chamber and a discharge chamber therein; a suction nozzle which is disposed in one side of the housing, and communicates with the suction chamber; a discharge nozzle which is disposed in the other side of the housing, and communicates with the discharge chamber; a partition wall which partitions the suction chamber and the discharge chamber, and has a communication hole, which communicates the suction chamber and the discharge chamber, that is formed at a central portion; and a plurality of baffles which are disposed inside the suction chamber, and guide fluid introduced through the suction nozzle to the communication hole, wherein the plurality of baffles have different lengths and are separated apart from each other in a circumferential direction in an upper side of the partition wall.

18 Claims, 8 Drawing Sheets

PUMP

CROSS-REFERENCE TO RELATED PATENT APPLICATIONS

This application claims priority under 35 U.S.C. § 119 to Korean Patent Application No. 10-2020-0019276 filed on Feb. 17, 2020, whose entire disclosure are hereby incorporated by reference.

BACKGROUND OF THE INVENTION

1. Field of the Invention

The present disclosure relates to a pump, and more particularly, to a pump for circulating water used in a laundry treatment apparatus or the like.

2. Description of the Related Art

In the case of a circulation pump, a separate chamber is provided in an upper space in which an impeller is disposed. In such a chamber, a separate apparatus for separating a gas or reducing a rotational component of a fluid, when the fluid is introduced and the fluid flows into the space in which the impeller is disposed, may be disposed.

Particularly, since the introduced fluid flows in along the outer circumferential surface of the chamber, it may be introduced into the chamber while having a rotational component. Such a rotational component may prevent fluid from flowing into a communication hole that is formed in the center of the chamber and communicates with the space in which the impeller is disposed European Patent EP01024292B1 discloses that as a pump upper housing structure, an annular wall surface is installed for the purpose of bubble separation by dividing an inflow passage and a mesh structure is installed.

When such an annular wall surface is applied, swirl occurs in the chamber. This may greatly increase the rotational speed component in the flow of the fluid moving to the space where the impeller is disposed. This rotational speed component becomes a factor that reduces the lift head of the pump generated by the rotation of the impeller.

SUMMARY OF THE INVENTION

The present disclosure has been made in view of the above problems, and provides a pump that smoothly moves the fluid sucked into a suction chamber to a discharge chamber in which an impeller is disposed.

The present disclosure further provides a pump that maximizes efficiency by reducing the rotational component of the fluid flowing into the suction chamber.

In accordance with an aspect of the present disclosure, a pump includes: a housing which forms a suction chamber and a discharge chamber therein; a suction nozzle which is disposed in one side of the housing, and communicates with the suction chamber; a discharge nozzle which is disposed in the other side of the housing, and communicates with the discharge chamber; a partition wall which partitions the suction chamber and the discharge chamber, and has a communication hole, which communicates the suction chamber and the discharge chamber, that is formed at a central portion; and a plurality of baffles which are disposed inside the suction chamber, and guide fluid introduced through the suction nozzle to the communication hole.

Here, the plurality of baffles have different lengths and are separated apart from each other in a circumferential direction in an upper side of the partition wall, thereby reducing the rotational force of the fluid introduced from the suction nozzle.

Length of each of the plurality of baffles is sequentially increased in a direction in which the fluid introduced into the suction nozzle flows, thereby reducing the rotational force of the fluid introduced from the suction nozzle.

The plurality of baffles forms a convex curved surface in the direction in which the fluid introduced into the suction nozzle flows, thereby reducing the rotational force of the fluid introduced from the suction nozzle.

In each of the plurality of baffles, one end portion, which is disposed adjacent to a center of the housing, is equally separated apart from the center of the housing in a radial direction.

In each of the plurality of baffles, a virtual line extending from one end portion disposed close to the center of the housing is formed to face the communication hole, thereby guiding the fluid flowing into the suction chamber toward the communication hole.

The housing includes: an upper housing forming the suction chamber; and a lower housing forming the discharge chamber, wherein the partition wall is formed between the upper housing and the lower housing to partition the suction chamber and the discharge chamber.

The upper housing includes a circumferential surface that has the same radius and extends in a vertical direction; and an upper surface that covers an upper side of the circumferential surface, wherein the suction nozzle is disposed in one side of the circumferential surface, thereby having a structure where the fluid flowing into the suction chamber has a rotating component, and minimizing the rotating component of the fluid sucked into the plurality of baffle structures of the present disclosure.

The plurality of baffles are extended upward from the partition wall to an upper surface of the upper housing, thereby guiding all of the fluid flowing into the suction chamber.

The plurality of baffles include: a first baffle which is disposed in an upper side of the partition wall, has a certain length, and extends radially outwardly; a second baffle which is disposed in the upper side of the partition wall, has a length longer than that of the first baffle, and extends radially outwardly; and at least one third baffle which is disposed in the upper side of the partition wall, has a length longer than that of the first baffle and shorter than that of the second baffle, and extends radially outwardly, such that the first baffle, the third baffle, and the second baffle are disposed to increase in length sequentially.

An outer end of the second baffle is disposed in contact with a circumferential surface of the upper housing.

In a portion where the suction nozzle and the housing are connected, a suction nozzle communication hole for communicating a suction passage formed inside the suction nozzle and the suction chamber is formed, wherein the first baffle and the second baffle are disposed adjacent to the suction nozzle communication hole.

The suction nozzle communication hole is disposed between the first baffle and the second baffle.

The suction nozzle is extended in a direction opposite to a direction in which the first baffle is disposed such that fluid flows in the direction in which the first baffle is disposed.

The first baffle, the at least one third baffle, and the second baffle are sequentially disposed in a direction in which the fluid introduced from the suction nozzle to the suction chamber flows, from the suction nozzle communication hole, thereby increasing the length of the plurality of baffles sequentially.

The plurality of baffles comprises a plurality of third baffles having a length longer than that of the first baffle and shorter than that of the second baffle, wherein the plurality of third baffles have different lengths.

Each of the plurality of third baffles has a length that increases from the first baffle toward a direction in which the fluid which is introduced into the suction chamber from the suction nozzle flows, thereby sequentially increasing the length of the plurality of third baffles disposed between the first baffle and the second baffle.

The partition wall has a shape which is inclined in a suction chamber direction as it progresses from an outer end in contact with the housing toward one end in which the communication hole is formed.

The partition wall includes: a border which extends in a direction in which the communication hole is formed from an outer end in contact with a circumferential surface of the housing; an incline which is formed from the border toward the communication hole and inclined toward the suction chamber; and a discharge guider which is bent in a direction of the discharge chamber from the incline.

The first baffle is disposed in an upper side of the incline, and the second baffle and the third baffle are disposed throughout the border from the incline.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION OF THE PREFERRED EMBODIMENTS

Figure 1:
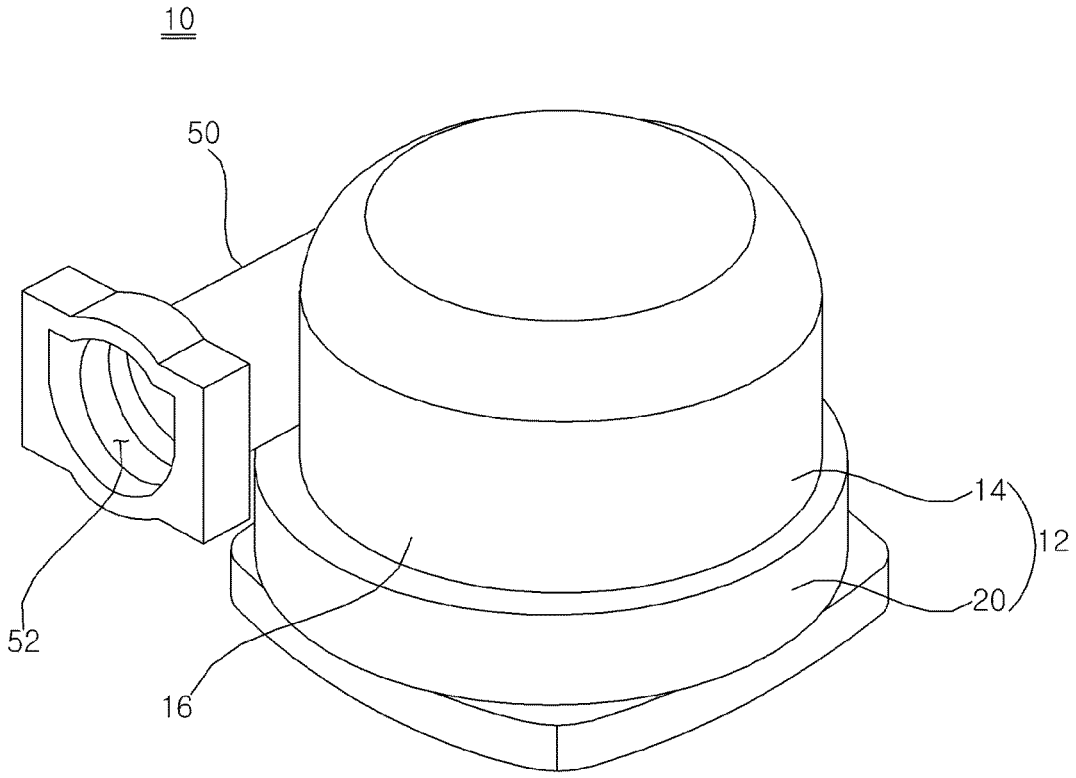
FIG. 1 is a perspective view of a pump according to an embodiment of the present disclosure.

Exemplary embodiments of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure.

Hereinafter, referring to the accompanying drawings, a preferred embodiment of the present disclosure will be described as follows.

Hereinafter, the present disclosure will be described with reference to the drawings for describing a pump according to embodiments of the present disclosure.

The pump 10 includes a housing 12 that forms a suction chamber 14*a* and a discharge chamber 20*a* therein, a suction nozzle 50 that is disposed in one side of the housing 12 and communicates with the suction chamber 14*a*, a discharge nozzle 62 that is disposed in one side of the housing 12 and communicates with the discharge chamber 20*a*, a partition wall 24 that divides the suction chamber 14*a* and the discharge chamber 20*a*, and has a communication hole 24*a*, which is formed at the center thereof, that communicates the suction chamber 14*a* and the discharge chamber 20*a*, a plurality of baffles 40, 42, 44*a*, 44*b*, 44*c*, 44*d*, 44*e* that are disposed inside the suction chamber 14*a* and guide the fluid flowing through the suction nozzle 50 to the communication hole 24*a*, and an impeller 66 that is disposed in the discharge chamber 20*a* and flows the fluid inside the housing 12 by rotation.

The housing 12 includes an upper housing 14 forming a suction chamber 14*a* and a lower housing 20 forming a discharge chamber 20*a*. Referring to FIG. 1, the upper housing 14 and the lower housing 20 are formed in a single configuration. However, unlike this, it is also possible to have a structure in which the upper housing 14 and the lower housing 20 are connected as a separate configuration.

Between the upper housing 14 and the lower housing 20, a partition wall 24 is formed to divide the suction chamber 14*a* and the discharge chamber 20*a*.

The upper housing 14 may have a cylindrical shape. The upper housing 14 includes a circumferential surface 16 that has the same radius and extends in a vertical direction, and an upper surface 18 that covers an upper side of the circumferential surface 16. In one side of the circumferential surface 16 of the upper housing 14, the suction nozzle 50 is disposed. The upper surface 18 may have a dome shape that is convex upward.

The suction nozzle 50 is connected to one side of the circumferential surface 16 of the upper housing 14. The suction nozzle 50 is formed in the tangential direction of the circumferential surface 16 at a portion connected to the circumferential surface 16 of the upper housing 14. Accordingly, the fluid flowing from the suction nozzle 50 into the upper housing 14 may flow toward the inner surface of the circumferential surface 16 rather than the center of the suction chamber 14*a*.

At one end of the suction nozzle 50, a suction port 52 communicating with the outside is formed, and a suction passage 54 is formed in a direction perpendicular to an opening surface formed by the suction port 52. The suction passage 54 formed in the suction nozzle 50 may be formed approximately in the same direction as the tangent line of the circumferential surface 16, at a portion in contact with the circumferential surface 16.

The suction nozzle 50 includes a suction nozzle circumferential surface 16 that has a cylindrical shape and forms a suction passage therein, and a suction nozzle end surface 58 that is disposed at the end of the suction nozzle circumferential surface 16 and forms a surface perpendicular to the suction nozzle circumferential surface 16. The suction nozzle end surface 58 may be disposed perpendicular to a virtual tangent line formed on the circumferential surface 16 of the housing 12 to which the suction nozzle end surface 58 contacts.

The suction nozzle 50 is in contact with the circumferential surface 16 of the upper housing 14 at one side of the suction nozzle 50. A suction nozzle communication hole 60 for communicating the suction passage 54 and the suction chamber 14*a* is formed at a portion where the suction nozzle 50 and the circumferential surface of the upper housing 14 are in contact with each other. The suction nozzle communication hole 60 is formed from one side of the suction nozzle end surface 58 to one side of the circumferential surface 16 of the suction nozzle.

The suction nozzle communication hole 60 is formed between a first baffle 40 and a second baffle 42 described below. The suction passage 54 is formed so that a fluid flows from a direction in which the second baffle 42 is disposed to a direction in which the first baffle 40 is disposed. Accordingly, the fluid flowing into the suction chamber 14*a* through the suction passage 54 flows in the direction in which the first baffle 40 is disposed.

The lower housing 20 is disposed below the upper housing 14. The lower housing 20 forms a discharge chamber 20*a* in which the impeller 66 is disposed therein. The lower housing 20 may have an upper side in which the partition wall 24 is disposed, and an opened lower side. A motor (not shown) for rotating the impeller 66 may be disposed below the lower housing 20.

Figure 2:
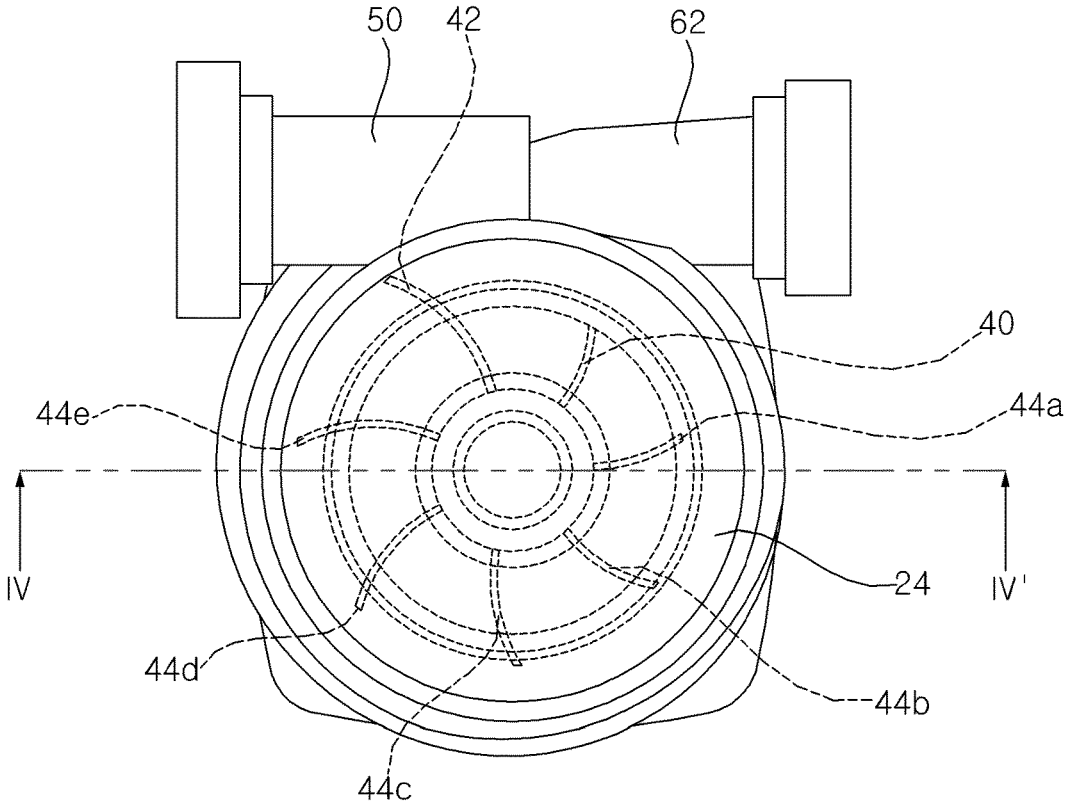
FIG. 2 is a plan view of a pump according to an embodiment of the present disclosure.
Figure 3:
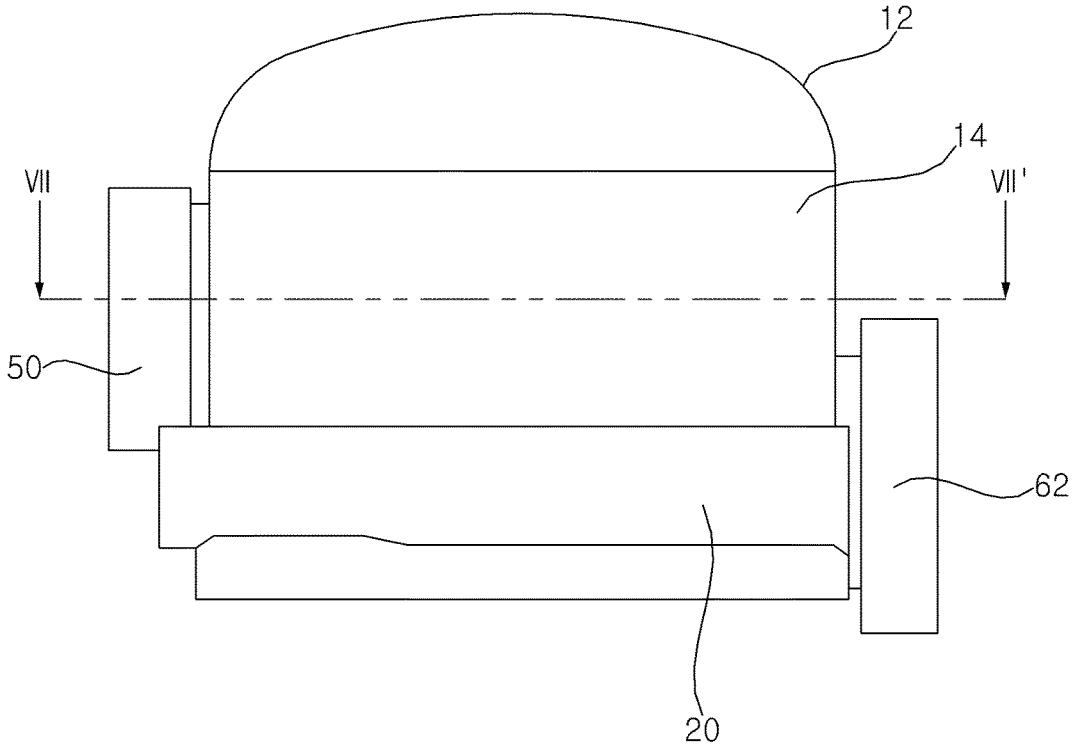
FIG. 3 is a front view of a pump according to an embodiment of the present disclosure.
Figure 4:
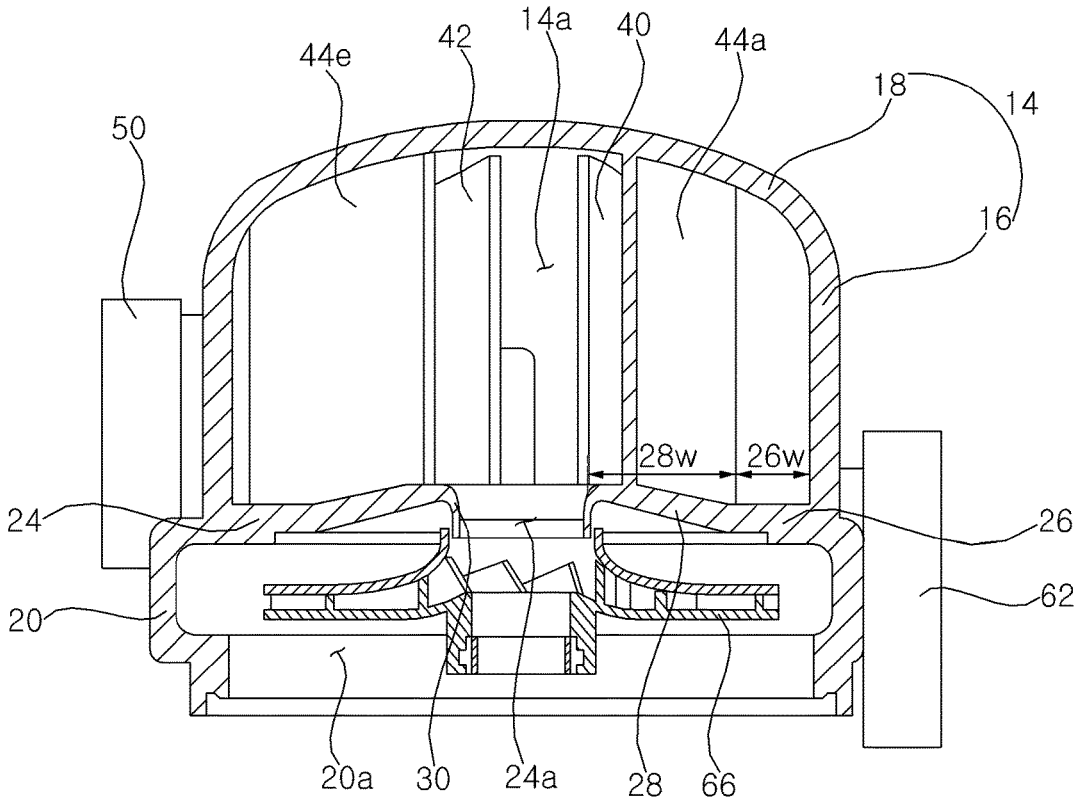
FIG. 4 is a cross-sectional view taken along line IV-IV' of FIG. 2.

A discharge nozzle 62 through which the fluid inside the discharge chamber 20*a* is discharged to the outside may be disposed in one side of the circumferential surface 16 of the lower housing 20. The discharge nozzle 62 may be formed to extend from the rotational direction of the impeller 66. Referring to FIG. 2, the discharge passage 64 may extend in a direction opposite to the suction passage 54.

The impeller 66 is disposed below the communication hole 24*a*, and may have a structure that moves the fluid of the suction chamber 14*a* downward and sends it in the radial direction.

Inside the housing 12, a partition wall 24 is formed that partitions the suction chamber 14*a* and the discharge chamber 20*a*. In the center of the partition wall 24, a communication hole 24*a* having a circular shape is formed. The communication hole 24*a* communicates the suction chamber 14*a* and the discharge chamber 20*a*.

The partition wall 24 includes a border 26 extended in the direction in which the communication hole 24*a* is formed from the outer end in contact with the circumferential surface 16 of the upper housing 14, an incline 28 formed in the direction of the communication hole 24*a* from the border 26 portion and inclined in the direction of the suction chamber 14*a*, and a discharge guider 30 bent in the direction of the discharge chamber 20*a* from the incline 28. The border 26 may form a surface perpendicular to the circumferential surface 16 of the upper housing 14. The width 28W formed by the incline 28 in the radial direction is formed to be larger than the width 26W formed by the border 26 in the radial direction. The inclination angle formed by the incline 28 with the border 26 may be formed in a range of 5 to 30 degrees.

Each of the plurality of baffles 40, 42, 44*a*, 44*b*, 44*c*, 44*d*, and 44*e* has a different length. The plurality of baffles 40, 42, 44*a*, 44*b*, 44*c*, 44*d*, and 44*e* form a convex curved surface in a direction in which the fluid flowing into the suction nozzle 50 flows. Here, the direction in which the fluid flowing into the suction nozzle 50 flows means a direction in which most of the fluid flowing into the suction chamber 14*a* through the suction nozzle communication hole 60 flows. Since the suction nozzle 50 has a structure extended in the opposite direction in which the first baffle 40 described below is disposed, most of the fluid flowing into the suction chamber 14*a* through the suction nozzle communication hole 60 may flow in the direction in which the first baffle 40 is disposed.

The plurality of baffles 40, 42, 44*a*, 44*b*, 44*c*, 44*d*, 44*e* extend upward from the partition wall 24 and may be connected to the upper surface 18 of the upper housing 14. The plurality of baffles 40, 42, 44*a*, 44*b*, 44*c*, 44*d*, 44*e* and the partition wall 24 may be formed in a single configuration. The plurality of baffles 40, 42, 44*a*, 44*b*, 44*c*, 44*d*, 44*e* are mainly disposed on the incline 28. The first baffle 40 is disposed in the incline 28. The second baffle 42 and the plurality of third baffles 44*a*, 44*b*, 44*c*, 44*d*, 44*e* may be disposed in the incline 28 and the border 26.

The incline 28 may form a side parallel to the border 26 at one end in contact with the discharge guider 30.

The discharge guider 30 may have a hollow cylindrical shape. The discharge guider 30 is provided with a communication hole 24*a* for communicating the suction chamber 14*a* and the discharge chamber 20*a*. The discharge guider 30 may send the fluid of the suction chamber 14*a* to the upper side of the impeller 66.

The plurality of baffles 40, 42, 44*a*, 44*b*, 44*c*, 44*d*, 44*e* are formed by extending upward from the partition wall 24. Each of the plurality of baffles 40, 42, 44*a*, 44*b*, 44*c*, 44*d*, 44*e* has a lower end connected to the partition wall 24 and an upper end connected to the upper surface 18 of the upper housing 14. The plurality of baffles 40, 42, 44*a*, 44*b*, 44*c*, 44*d*, 44*e* are formed radially from the center of the partition wall 24. The plurality of baffles 40, 42, 44*a*, 44*b*, 44*c*, 44*d*, 44*e* are separated apart at certain intervals in the circumferential direction.

The plurality of baffles 40, 42, 44*a*, 44*b*, 44*c*, 44*d*, 44*e* form a convex curved surface in one direction. The plurality of baffles 40, 42, 44*a*, 44*b*, 44*c*, 44*d*, 44*e* may form a convex curved surface in a direction in which fluid flows from the suction nozzle 50. The plurality of baffles 40, 42, 44*a*, 44*b*, 44*c*, 44*d*, 44*e* may form a convex curved surface in the same direction.

The plurality of baffles 40, 42, 44*a*, 44*b*, 44*c*, 44*d*, 44*e* may have different lengths. Each of the plurality of baffles 40, 42, 44*a*, 44*b*, 44*c*, 44*d*, 44*e* has one end portion 401, 421, 44*a*1, 44*b*1, 44*c*1, 44*d*1, 44*e*1, which is disposed close to the center of the housing 12, that is equally separated in the radial direction from the center of the housing 12.

Therefore, in each of the plurality of baffles 40, 42, 44*a*, 44*b*, 44*c*, 44*d*, 44*e* that have the other end portion 402, 422, 44*a*2, 44*b*2, 44*c*2, 44*d*2, 44*e*2 disposed adjacent to the circumferential surface of the housing 12, the distance of the other end portion 402, 422, 44*a*2, 44*b*2, 44*c*2, 44*d*2, 44*e*2 separated from the center of the housing 12 in the radial direction may be formed to be different from each other.

In each of the plurality of baffles 40, 42, 44*a*, 44*b*, 44*c*, 44*d*, 44*e*, a virtual line extended from one end portion 401, 421, 44*a*1, 44*b*1, 44*c*1, 44*d*1, 44*e*1 disposed close to the center of the housing 12 is formed to face the communication hole 24*a*. A virtual line extended from one end portion 401, 421, 44*a*1, 44*b*1, 44*c*1, 44*d*1, 44*e*1 of each of the plurality of baffles 40, 42, 44*a*, 44*b*, 44*c*, 44*d*, 44*e* may be disposed to face the center of the communication hole 24*a*.

The plurality of baffles 40, 42, 44*a*, 44*b*, 44*c*, 44*d*, 44*e* includes a first baffle 40 that is disposed in an upper side of the partition wall 24, has a certain length, and extends radially outwardly, a second baffle 42 that is disposed in an upper side of the partition wall 24, has a length longer than that of the first baffle 40, and extends radially outwardly, and at least one third baffle that is disposed in an upper side of the partition wall 24, has a length longer than that of the first baffle 40 and shorter than that of the second baffle 42, and extends radially outwardly.

The plurality of baffles 40, 42, 44*a*, 44*b*, 44*c*, 44*d*, 44*e* includes a first baffle 40 that is disposed perpendicular to the partition wall 24, and has a radial outer end portion separated at a certain interval from the circumferential surface 16 of the upper housing 14, a second baffle 42 that is disposed perpendicular to the partition wall 24, and has a radial outer end portion in contact with the circumferential surface 16 of the upper housing 14, and a plurality of third baffles that are disposed between the first baffle 40 and the second baffle 42 in the circumferential direction, and have a length longer than the first baffle 40 and shorter than the second baffle 42.

Figure 7:
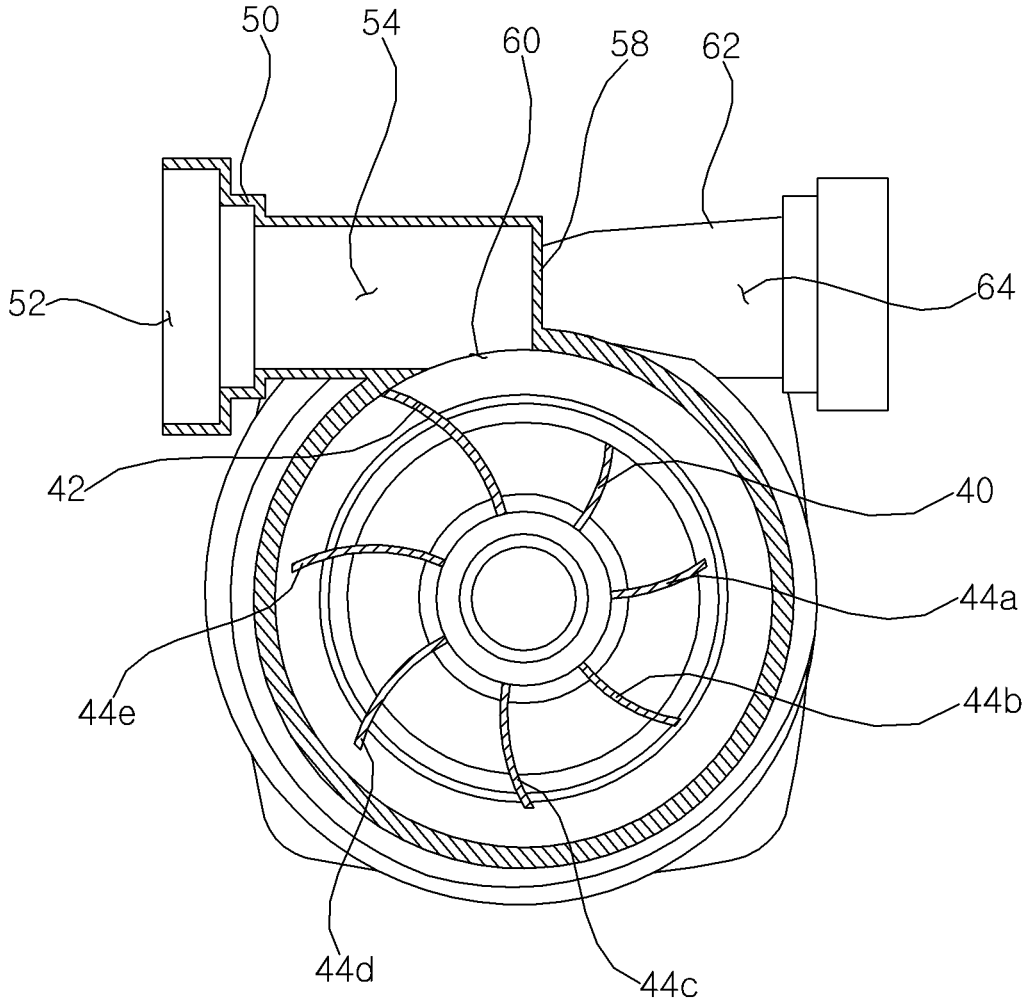
FIG. 7 is a cross-sectional view taken along line VII-VII' of FIG. 4.

The first baffle 40 and the second baffle 42 are disposed closer to the suction nozzle communication hole 60 than the plurality of third baffles 44*a*, 44*b*, 44*c*, 44*d*, 44*e*. The first baffle 40 is separated apart from the suction nozzle communication hole 60 in a first circumferential direction. The second baffle 42 is separated apart from the suction nozzle communication hole 60 in a second circumferential direction. Here, the first circumferential direction and the second circumferential direction mean a circumferential direction formed based on the center of the housing 12, or may mean the opposite direction. That is, referring to FIG. 7, the first circumferential direction may be set to a clockwise direction, and the second circumferential direction may be set to a counterclockwise direction. The second baffle 42 is disposed in the second circumferential direction of the first baffle 40. A plurality of third baffles 44*a*, 44*b*, 44*c*, 44*d*, 44*e* are disposed in the first circumferential direction of the first baffle 40.

In the plurality of baffles 40, 42, 44*a*, 44*b*, 44*c*, 44*d*, 44*e*, the first baffle 40, the plurality of third baffles 44*a*, 44*b*, 44*c*, 44*d*, 44*e*, and the second baffle 42 are sequentially disposed in the first circumferential direction based on the suction nozzle communication hole 60. The length of each of the plurality of third baffles 44*a*, 44*b*, 44*c*, 44*d*, 44*e* is increased gradually in the first circumferential direction.

The plurality of baffles 40, 42, 44*a*, 44*b*, 44*c*, 44*d*, 44*e* form a convex curved surface in the first circumferential direction. The first baffle 40 forms a curved surface in which the first surface 40*a* contacting the fluid introduced through the suction nozzle communication hole 60 is convex toward the second surface 40*b*. The fluid flowing into the suction chamber 14*a* through the suction nozzle communication hole 60 moves in the first circumferential direction. The plurality of baffles 40, 42, 44*a*, 44*b*, 44*c*, 44*d*, 44*e* form a convex curved surface in the first circumferential direction in which the washing water in the suction chamber 14*a* flows.

Figure 8:
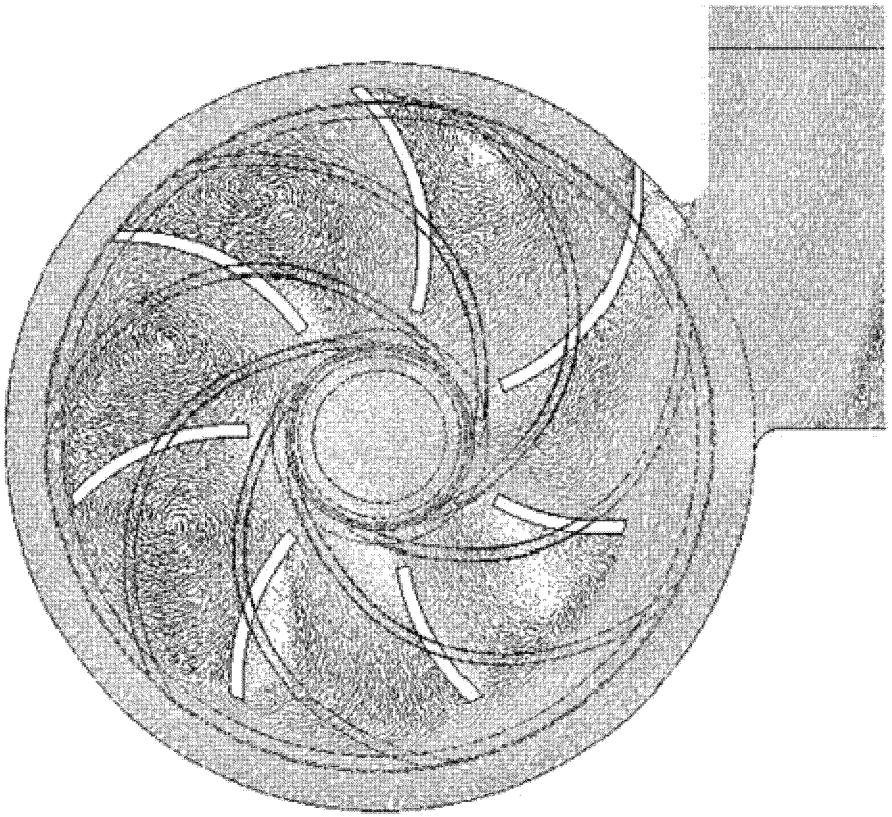
FIG. 8 is a view showing a flow amount of a fluid inside a suction chamber according to an embodiment of the present disclosure.

Referring to FIG. 8, fluid flowing into the suction chamber 14*a* through the suction nozzle 50 may flow along a first surface of each of the plurality of baffles 40, 42, 44*a*, 44*b*, 44*c*, 44*d*, 44*e*. At this time, since the length of the plurality of baffles 40, 42, 44*a*, 44*b*, 44*c*, 44*d*, 44*e* is formed to increase sequentially, the amount of fluid that moves along the plurality of baffles 40, 42, 44*a*, 44*b*, 44*c*, 44*d*, 44*e* may be similarly formed. That is, the rotational component of the fluid introduced through the suction nozzle 50 is reduced while moving along the plurality of baffles 40, 42, 44*a*, 44*b*, 44*c*, 44*d*, 44*e*, and the fluid may move to the communication hole 24*a*.

Figure 5:
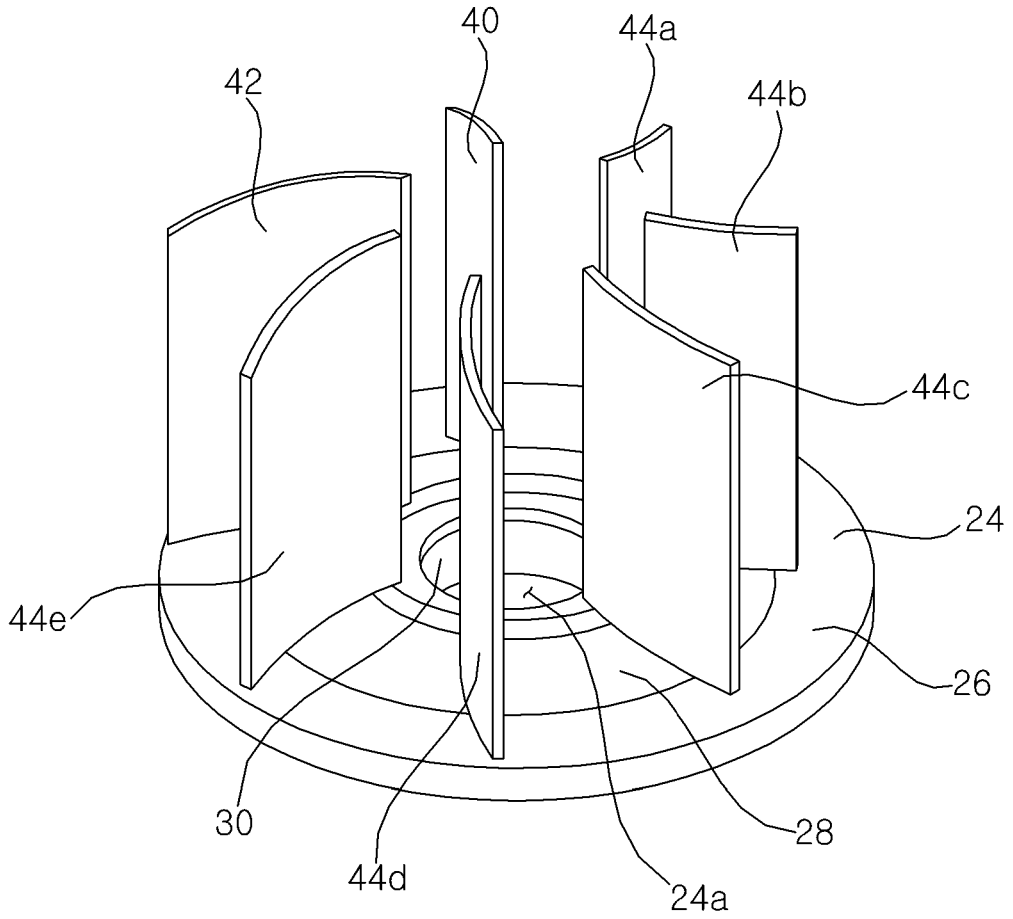
FIG. 5 is a perspective view of a partition wall and a plurality of baffles according to an embodiment of the present disclosure.
Figure 6:
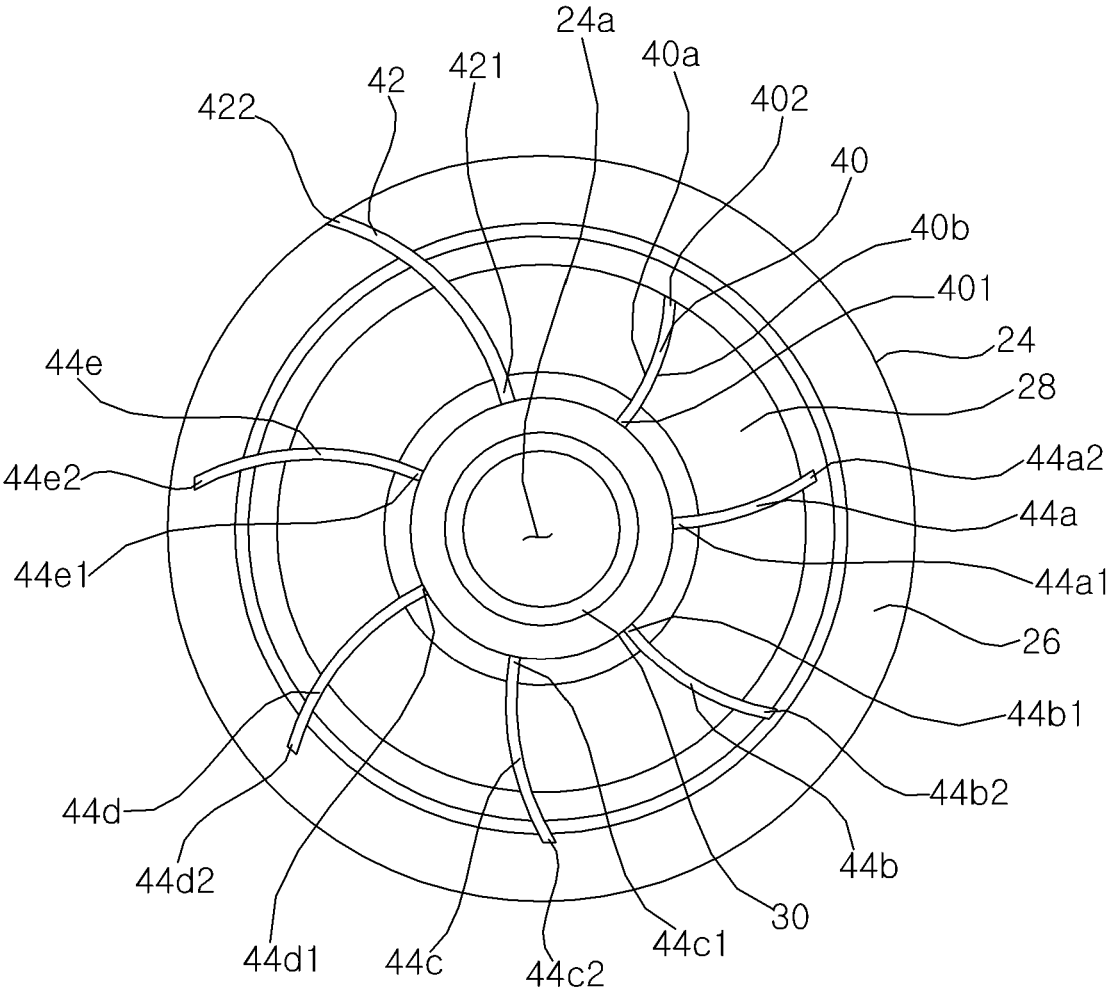
FIG. 6 is a plan view of a partition wall and a plurality of baffles according to an embodiment of the present disclosure.

The plurality of third baffles 44*a*, 44*b*, 44*c*, 44*d*, and 44*e* may have different lengths. Each of the plurality of third baffles 44*a*, 44*b*, 44*c*, 44*d*, 44*e* increases in length from the first baffle 40 in the first circumferential direction. The rate of increase in length according to the disposition of the plurality of third baffles 44*a*, 44*b*, 44*c*, 44*d*, 44*e* may be set in consideration of a difference between the length of the first baffle 40 and the length of the second baffle 42, and the number of the plurality of third baffles. Referring to FIGS. 5 to 6, in the present disclosure, the third baffle may be composed of total five ones. However, this is just an embodiment, and the number of third baffles may vary depending on the size of the pump.

According to the pump of the present disclosure, one or more of the following effects are provided.

First, since it has a structure that length is sequentially increased so that a plurality of baffles guide the fluid flowing from the suction nozzle, the rotational component of the fluid flowing into the suction chamber is reduced. Accordingly, there is an advantage in that the fluid flowing into the suction chamber can smoothly flow into the discharge chamber where the impeller is disposed.

Second, since the plurality of baffles have a convex shape in a direction opposite to the direction in which the fluid flows, there is also an advantage of maximizing a reduction in the rotational component of the fluid.

Third, the plurality of baffles have a structure that extends in the vertical direction inside the suction chamber, thereby generally guiding the fluid flowing into the suction chamber.

Although the exemplary embodiments of the present disclosure have been disclosed for illustrative purposes, those skilled in the art will appreciate that various modifications, additions and substitutions are possible, without departing from the scope and spirit of the invention as disclosed in the accompanying claims. Accordingly, the scope of the present disclosure is not construed as being limited to the described embodiments but is defined by the appended claims as well as equivalents thereto.

What is claimed is:

1. A pump comprising:

a housing which forms a suction chamber and a discharge chamber therein;

a suction nozzle which is disposed in one side of the housing, and communicates with the suction chamber;

a discharge nozzle which is disposed in the other side of the housing, and communicates with the discharge chamber;

a partition wall which partitions the suction chamber and the discharge chamber, and has a communication hole, which communicates the suction chamber and the discharge chamber, that is formed at a central portion; and a plurality of baffles which are disposed inside the suction chamber, and guide fluid introduced through the suction nozzle to the communication hole, wherein the plurality of baffles have different lengths and are separated apart from each other in a circumferential direction in an upper side of the partition wall, wherein the length of each of the plurality of baffles is sequentially increased in a direction in which the fluid introduced into the suction nozzle flows.

2. The pump of claim 1, wherein each of the plurality of baffles forms a convex curved surface in the direction in which the fluid introduced into the suction nozzle flows.

3. The pump of claim 1, wherein in each of the plurality of baffles, a virtual line extending from one end portion, disposed close to a center of the housing, is formed to face the communication hole.

4. The pump of claim 1, wherein the housing comprises:

an upper housing forming the suction chamber; and a lower housing forming the discharge chamber, wherein the partition wall is formed between the upper housing and the lower housing to partition the suction chamber and the discharge chamber.

5. The pump of claim 4, wherein the upper housing comprises:

a circumferential surface that has the same radius and extends in a vertical direction; and an upper surface that covers an upper side of the circumferential surface, wherein the suction nozzle is disposed in one side of the circumferential surface.

6. The pump of claim 4, wherein the plurality of baffles are extended upward from the partition wall to an upper surface of the upper housing.

7. The pump of claim 1, wherein the plurality of baffles comprise:

a first baffle which is disposed in an upper side of the partition wall, has a certain length, and extends radially outwardly;

a second baffle which is disposed in the upper side of the partition wall, has a length longer than that of the first baffle, and extends radially outwardly; and at least one third baffle which is disposed in the upper side of the partition wall, has a length longer than that of the first baffle and shorter than that of the second baffle, and extends radially outwardly.

8. The pump of claim 7, wherein an outer end of the second baffle is disposed in contact with a circumferential surface of an upper housing.

9. The pump of claim 7, wherein, in a portion where the suction nozzle and the housing are connected, a suction nozzle communication hole for communicating a suction passage formed inside the suction nozzle and the suction chamber is formed, wherein the first baffle and the second baffle are disposed adjacent to the suction nozzle communication hole.

10. The pump of claim 9, wherein the suction nozzle communication hole is disposed between the first baffle and the second baffle.

11. The pump of claim 9, wherein the first baffle, the at least one third baffle, and the second baffle are sequentially disposed in a direction in which the fluid introduced from the suction nozzle to the suction chamber flows.

12. The pump of claim 7, wherein the suction nozzle is extended in a direction opposite to a direction in which the first baffle is disposed.

13. The pump of claim 7, wherein the plurality of baffles comprises a plurality of third baffles having a length longer than that of the first baffle and shorter than that of the second baffle, wherein each of the plurality of third baffles has different length.

14. The pump of claim 13, wherein length of each of the plurality of third baffles is increased from the first baffle toward a direction in which the fluid which is introduced into the suction chamber from the suction nozzle flows.

15. The pump of claim 7, wherein the partition wall has a shape which is inclined in a suction chamber direction as it progresses from an outer end in contact with the housing toward one end in which the communication hole is formed.

16. The pump of claim 15, wherein the partition wall comprises:

a border which extends in a direction in which the communication hole is formed from an outer end in contact with a circumferential surface of the housing;

an incline which is formed from the border toward the communication hole and inclined toward the suction chamber; and a discharge guider which is bent in a direction of the discharge chamber from the incline.

17. The pump of claim 16, wherein the first baffle is disposed in an upper side of the incline, and the second baffle and the third baffle are disposed throughout the border from the incline.

18. A pump comprising:

a housing which forms a suction chamber and a discharge chamber therein;

a suction nozzle which is disposed in one side of the housing, and communicates with the suction chamber;

a discharge nozzle which is disposed in the other side of the housing, and communicates with the discharge chamber;

a partition wall which partitions the suction chamber and the discharge chamber, and has a communication hole, which communicates the suction chamber and the discharge chamber, that is formed at a central portion; and a plurality of baffles which are disposed inside the suction chamber, and guide fluid introduced through the suction nozzle to the communication hole, wherein the plurality of baffles have different lengths and are separated apart from each other in a circumferential direction in an upper side of the partition wall, wherein in each of the plurality of baffles, one end portion, which is disposed adjacent to a center of the housing, is equally separated apart from the center of the housing in a radial direction.

* * * * *